US011236444B2

(12) United States Patent
Meinecke

(10) Patent No.: US 11,236,444 B2
(45) Date of Patent: Feb. 1, 2022

(54) OXIDATION FURNACE

(71) Applicant: EISENMANN SE, Boeblingen (DE)

(72) Inventor: Lars Meinecke, Reutlingen (DE)

(73) Assignee: EISENMANN SE, Böblingen (DE)

( * ) Notice: Subject to any disclaimer, the term of this patent is extended or adjusted under 35 U.S.C. 154(b) by 0 days.

(21) Appl. No.: 15/320,070

(22) PCT Filed: Jun. 16, 2015

(86) PCT No.: PCT/EP2015/001215
§ 371 (c)(1),
(2) Date: Dec. 19, 2016

(87) PCT Pub. No.: WO2015/192962
PCT Pub. Date: Dec. 23, 2015

(65) Prior Publication Data

US 2017/0145598 A1 May 25, 2017

(30) Foreign Application Priority Data

Jun. 20, 2014 (DE) ..... 10 2014 009 244.5

(51) Int. Cl.
*D01F 9/32* (2006.01)
*F27B 9/28* (2006.01)
*D02J 13/00* (2006.01)

(52) U.S. Cl.
CPC ..... *D01F 9/32* (2013.01); *D02J 13/00* (2013.01); *D02J 13/001* (2013.01); *F27B 9/28* (2013.01)

(58) Field of Classification Search
CPC ..... D01F 9/32; D01F 9/12; F27B 9/28; F27B 2009/3027
(Continued)

(56) References Cited

U.S. PATENT DOCUMENTS 4,428,081 A * 1/1984 Smith ..... A61F 9/025 2/422
4,675,957 A 6/1987 McAliley et al.
(Continued)

FOREIGN PATENT DOCUMENTS

CN 102 758 270 A 10/2012
CN 103 717 792 A 4/2014
(Continued)

OTHER PUBLICATIONS

Unpublished U.S. Appl. No. 17/043,343, filed Oct. 9, 2020 to Inventors Muck et al.

*Primary Examiner* — Steven B McAllister
*Assistant Examiner* — Benjamin W Johnson
(74) *Attorney, Agent, or Firm* — Schroeder Intellectual Property Law Group, LLC

(57) ABSTRACT

An oxidation furnace for the oxidative treatment of fibers having a housing which is gas-tight, apart from passage openings for the fibers, inter alia. A process chamber is located in the interior of the housing. Deflecting rollers guide the fibers through the process chamber in a serpentine manner so that the fibers lie next to one another as a fiber carpet which spans a plane between opposite deflecting rollers. An atmosphere-generating device can generate a hot working atmosphere and includes a blowing device with at least one outlet window through which a hot working atmosphere can be blown into the process chamber between two adjacent planes of the fiber carpet (22*a*). The working atmosphere is guided into the process chamber by a flow guiding system. The flow guiding system includes exchangeable flow guiding elements with flow passages which can be detachably and/or movably mounted on the blowing device, before the outlet window.

13 Claims, 7 Drawing Sheets

(58) Field of Classification Search
USPC ..... 432/120; 423/447.1
See application file for complete search history.

(56) References Cited

U.S. PATENT DOCUMENTS

| | | | | |
|---|---|---|---|---|
| 5,908,290 | A * | 6/1999 | Kawamura | D01F 9/32 34/636 |
| 6,073,296 | A * | 6/2000 | Bouguerfa | A42B 3/26 15/102 |
| 8,955,235 | B2 | 2/2015 | Berner | |
| 9,139,936 | B2 | 9/2015 | Meinecke et al. | |
| 9,157,679 | B2 | 10/2015 | Kaji et al. | |
| 9,303,921 | B2 | 4/2016 | Berner | |
| 9,441,881 | B2 | 9/2016 | Berner | |
| 9,834,869 | B2 | 12/2017 | Kaji et al. | |
| 10,222,122 | B2 | 3/2019 | Berner et al. | |
| 2012/0304479 | A1 | 12/2012 | Berner | |
| 2012/0304480 | A1 | 12/2012 | Berner | |
| 2013/0171578 | A1 | 7/2013 | Berner | |
| 2014/0026437 | A1 | 1/2014 | Meinecke et al. | |
| 2014/0161711 | A1 * | 6/2014 | Kaji | D01F 9/32 423/447.1 |
| 2015/0210925 | A1 | 7/2015 | Oka et al. | |
| 2016/0002828 | A1 | 1/2016 | Kaji et al. | |
| 2017/0122664 | A1 | 5/2017 | Meinecke | |
| 2019/0194830 | A1 | 6/2019 | Meinecke | |
| 2020/0181809 | A1 | 6/2020 | Muck et al. | |

FOREIGN PATENT DOCUMENTS

| | | | |
|---|---|---|---|
| DE | 10 2010 044 296 | B3 | 1/2012 |
| DE | 10 2011 010 298 | B3 | 6/2012 |
| EP | 2 738 292 | | 6/2014 |
| EP | 2 534 287 | B1 | 11/2014 |
| JP | S58-208433 | A | 12/1983 |
| JP | S59-112063 | A | 6/1984 |
| JP | 2007-247130 | A | 9/2007 |
| JP | 2007247130 | A * | 9/2007 |
| JP | 2008-202158 | A | 9/2008 |
| WO | 2011/098223 | A1 | 8/2011 |
| WO | 2014/002879 | A1 | 1/2014 |

* cited by examiner

OXIDATION FURNACE

RELATED APPLICATIONS

This application is a national phase of International Patent Application No. PCT/EP2015/001215, filed Jun. 16, 2015, which claims the filing benefit of German Patent Application No. 10 2014 009 244.5, filed Jun. 20, 2014, the contents of both of which are incorporated herein by reference.

FIELD OF THE INVENTION

The invention relates to an oxidation furnace for the oxidative treatment of fibers, in particular for producing carbon fibers, the oxidation furnace having a) a housing which except for passage openings for the fibers, inter alia, is gas tight;

b) a process chamber which is located in the interior of the housing;

c) deflection rollers which guide the fibers in a serpentine manner such that they lie beside one another in the form of a fiber carpet through the process chamber, wherein the fiber carpet defines a plane between respective mutually opposite deflection rollers;

d) an atmosphere generating installation, by way of which a hot operating atmosphere is generatable, and which comprises a blower installation having at least one exit window through which hot operating atmosphere is capable of being blown into the process chamber between two adjacent planes of the fiber carpet; wherein e) the operating atmosphere reaches the process chamber by way of a flow directing installation.

BACKGROUND OF THE INVENTION

In the case of oxidation furnaces of this type that are commercially available, the blower installation comprises, for example, a plurality of blower boxes from which the operating atmosphere enters the process chamber. An exit window therein is formed by an exit wall of a respective blower box that has a multiplicity of flow passages. Accordingly, these flow passages define a flow directing installation, the flow of the operating atmosphere being influenced by the arrangement and the geometry of the latter.

Contaminations, in particular in the form of silicon dioxide and fiber abrasion from the fibers, are deposited on the flow passages during the operation of the oxidation furnace. For this reason, at least the flow openings have to be cleaned at regular intervals in order to maintain the flow of the operating atmosphere in a reproducible manner.

The blower boxes are fixedly installed in the furnace, and the flow passages of the former are most often difficult to access. Moreover, the fibers often have to be displaced at least on the deflection rollers or to some extent also have to be completely removed from the process chamber so as to be able to carry out adequate cleaning.

On account thereof, the overall cleaning procedure is very time and labor intensive and, on account thereof, also costly.

SUMMARY OF THE INVENTION

It is therefore an object of the present invention to provide an oxidation furnace that takes these considerations into account.

This object may be achieved by an oxidation furnace of the type mentioned at the outset in that f) the flow directing installation comprises replaceable flow directing elements having flow passages which are mountable in a releasable and/or movable manner in front of the exit window on the blower installation.

According to the invention it has been acknowledged that in the case of an otherwise fixedly installed blower installation at least the flow passages may be provided by replaceable flow directing elements which for the purpose of cleaning may be removed from the process chamber at the right time and be replaced by non-stressed flow directing elements. The contaminated and removed flow directing elements may then be cleaned elsewhere rather than the process chamber. On account thereof, works in the interior of the furnace are dispensed with above all.

It is favorable for the exit window to extend substantially from a first longitudinal wall to an opposite second longitudinal wall of the housing. In this way, the entire width of the oxidation furnace may be covered, and access may preferably be carried out from the longitudinal side of the oxidation furnace.

A flow directing element is preferably mountable in a holding installation.

It has proven favorable in practice for the holding installation to comprise guide rails, extending along the upper and lower peripheries of the exit window, for a flow directing element. In this way, reliable guiding of the flow directing element is guaranteed even when the latter is handled only from the longitudinal side of the oxidation furnace.

In order for works in the process chamber to be avoided it is preferable for access means by way of which the flow directing element is accessible from outside the process chamber to be provided.

It is of particular advantage herein for the access means to be configured by a passage opening in a longitudinal wall of the housing, or by two mutually opposite passage openings in two mutually opposite longitudinal walls of the housing. In terms of construction, this is particularly easy to implement.

The flow directing element is preferably configured as an elongate plate by way of which the exit window of the blower installation is completely coverable. This elongate plate may preferably be a steel panel, for example. In this case, one respective passage opening in only one longitudinal wall of the oxidation furnace suffices, for replacing flow directing elements, for example.

Alternatively or additionally, two or a plurality of flow directing elements in the form of flow directing modules may also be present, two or a plurality of the latter covering one exit window. Said flow directing modules then interact with opposite passage openings in the longitudinal walls of the oxidation furnace, for example, such that at least one of the flow directing modules is in each case guided through a respective passage opening.

Likewise alternatively or additionally, the flow directing element may is configured by a wound tape which is stretched and movable along the exit window between a source roll and a take-up roll such that a portion of the wound tape covers the exit window. Such a wound tape may be guided past the exit window in an intermittent or continuous manner.

If and when the rolls are disposed outside the housing and the wound tape is guided through two mutually opposite passage openings in two mutually opposite longitudinal walls of the housing, the rolls may advantageously be handled without access to the process chamber being required.

A cleaning installation through which the wound tape upon leaving the process chamber is guided may advantageously be present. In this way, cleaning may still be performed in the furnace surroundings, and the cleaned wound tape may optionally be re-employed in a more direct circulation.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention will be explained in more detail hereunder by means of the drawings in which.

DETAILED DESCRIPTION OF THE PRESENT INVENTION

Figure 1:
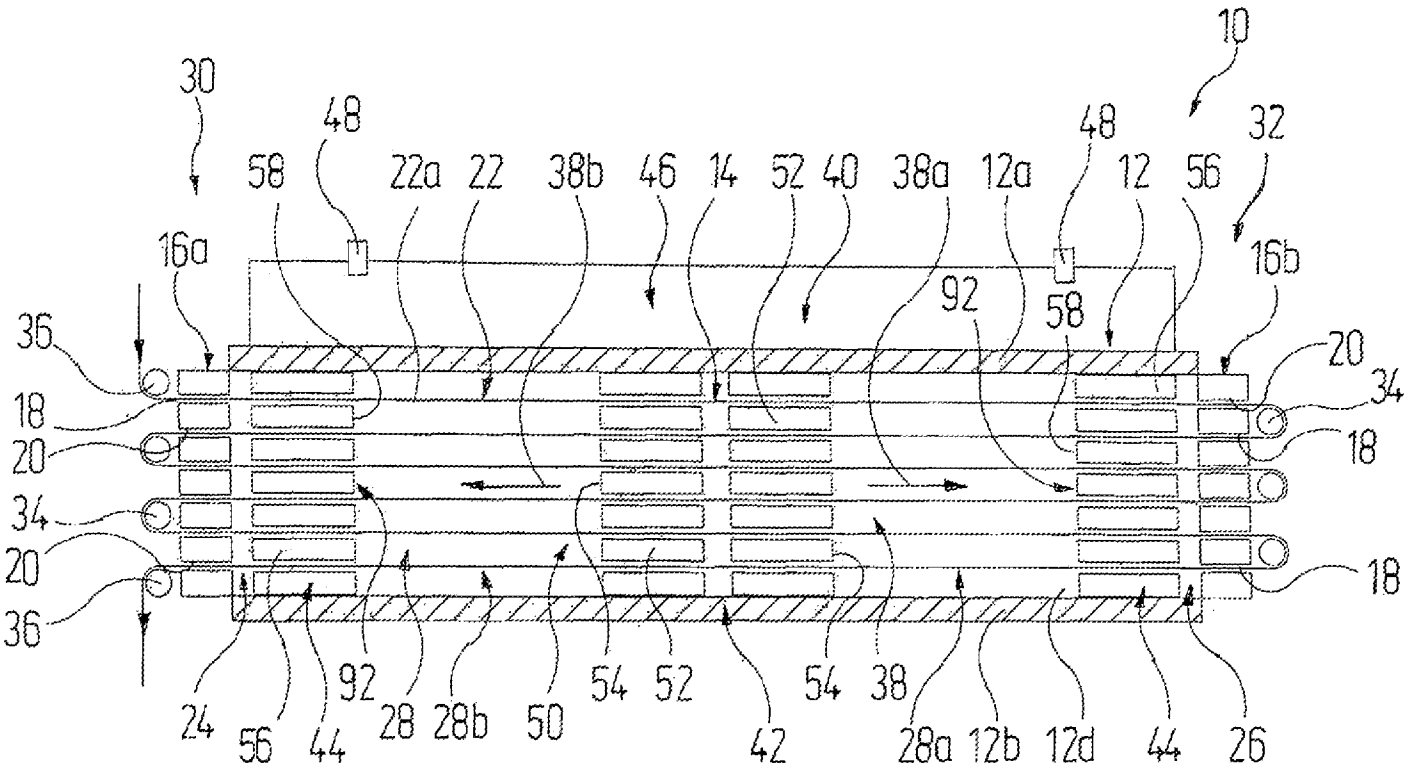
FIG. 1 shows a vertical section in the longitudinal direction of the furnace through an oxidation furnace for producing carbon fibers, having an atmosphere generating installation by way of which a hot operating atmosphere is generatable and is capable of being blown into the process chamber, and a flow directing installation for homogenizing the atmospheric flow.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Reference is made first to FIG. 1 which shows a vertical section of an oxidation furnace that is employed for producing carbon fibers and overall is referred to as 10.

The oxidation furnace 10 comprises a housing 12 which by way of a ceiling wall 12*a* and a floor wall 12*b* and two vertical longitudinal walls 12*c*, 12*d* delimits a passage chamber that forms the interior 14 of the oxidation furnace 10; of said longitudinal walls 12*c*, 12*d* only that longitudinal wall 12*d* that lies behind the section plane being visible in FIG. 1.

At each end side thereof, the housing 12 has one end wall 16*a*, 16*b*, wherein in the end wall 16*a* passage openings in the form of horizontal entry slots 18 and exit slots 20 are present in an alternating manner from top to bottom, and in the end wall 16*b* passage openings in the form of horizontal exit slots 20 and entry slots 18 are present in an alternating manner from top to bottom, not all of said slots having a reference sign for the sake of clarity. Fibers 22 are guided into the interior 14 and out of the latter again through the entry and exit slots 18 and 20, respectively. The entry and exit slots 18, 20 generally form passage regions of the housing 12 for the carbon fibers 22. Except for these passage openings and those explained further below, the housing 12 of the oxidation furnace 10 is gas tight.

The interior 14 in turn in the longitudinal direction is subdivided into three regions, and comprises a first antechamber 24 which is disposed directly beside the end wall 16*a*, a second antechamber 26 which is directly adjacent to the opposite end wall 16*b*, and a process chamber 28 which is located between the antechambers 24, 26.

The antechambers 24 and 26 thus simultaneously form an entry and exit lock for the fibers 22 into the interior 14 or into the process chamber 28, respectively.

The fibers 22 to be treated are fed to the interior 14 of the oxidation furnace 10 so as to run in parallel as a type of fiber carpet 22*a*. To this end, the fibers 22, from a first deflection region 30 which lies next to the end wall 16*a*, outside the furnace housing 12, through the topmost entry slot 18 in the end wall 16*a* enter the first antechamber 24. The fibers 22 thereafter are guided through the process chamber 28 and through the second antechamber 26 to a second deflection region 32 which lies next to the end wall 16*b*, outside the furnace housing 12, and from there back again.

In total, the fibers 22 pass through the process chamber 28 in a serpentine manner by way of deflection rollers 34 which are sequential from the top to the bottom, and of which only two have a reference sign. The fiber carpet 22*a*, which is formed by the multiplicity of fibers 22 that run beside one another, defines a plane between each of the deflection rollers 34. The running pattern of the fibers may also be performed from the bottom to the top, and there may also be more or fewer planes defined than are shown in FIG. 1.

After the entire passage through the process chamber 28, the fibers 22 in the present exemplary embodiment exit the oxidation furnace 10 through the lowermost exit slot 20 in the end wall 16*a*. Prior to reaching the topmost entry slot 18 in the end wall 16*a*, and after exiting the oxidation furnace through the lowermost exit slot 20 in the end wall 16*a*, the fibers 22 outside the furnace housing 12 are guided by way of further guide rollers 36.

The process chamber 28 under process conditions is perfused by a hot operating atmosphere 38 which is built up by an atmosphere generating installation 40. In general terms, by way of the atmosphere generating installation 40 a hot operating atmosphere 38 which under process conditions perfuses the process chamber 28 may be generated and blown into the process chamber 28.

There are two opposing hot air streams 38*a*, 38*b* in the present exemplary embodiment, each having a main flow direction that is visualized by an arrow, on account of which the process chamber 28 in terms of flow technology is subdivided into two process chamber portions 28*a*, 28*b*. One blower installation 42 is disposed in the central region of the process chamber 28, and one suction installation 44 is disposed in each of the two outboard end regions of the process chamber 28, each of said suction installations 44 being adjacent to the antechambers 24, 26, respectively.

Proceeding from the suction installations 44, the air is conveyed into an air directing chamber 46, lying behind the drawing plane in FIG. 1, in which said air is prepared and conditioned in a manner of no further interest herein, wherein in particular the temperature of said air is set by way of heating apparatuses (not separately shown here).

Moreover, two outlets 48 are provided in the region of the air directing chamber 46. Those volumes of gas or air, respectively, that are either created in the oxidation process, or that reach the process chamber 28 as fresh air through a supply air installation (not separately shown here), may be discharged by way of said outlets 48, so as to maintain the balance of air in the oxidation furnace 10. The discharged gases, which may also contain toxic components, are fed to thermal post-combustion. The heat that is potentially recovered herein may be used at least for pre-heating the fresh air that is fed to the oxidation furnace 10.

From the air directing chamber 46 the air in each case reaches the blower installation 42. The latter releases the now recirculated and conditioned air into the process chamber 28. The fibers 22 during the serpentine passage through the process chamber 28 are thus bathed in hot oxygen-containing air, and herein are oxidated.

In order for the operating atmosphere 38 to perfuse the process chamber 28 in a largely homogeneous manner, the operating atmosphere by way of a flow directing installation 50 which will be discussed in more detail further below reaches the process chamber 28. The flow directing installation 50 causes the flow of the operating atmosphere 38 between in each case adjacent fiber carpets 22*a* to be largely uniform across the furnace cross section such that there are no significant dissimilarities in the case of different planes, in particular in terms of flow velocities and in terms of the temperature distribution across the process chamber 28.

In the present exemplary embodiment the operating atmosphere 38 is released in an opposing flow in the direction of the deflection regions 30 and 32 into the process chamber portions 28*a*, 28*b*. In the latter, the air streams 38*a*, 38*b* flow counter to the respective suction installations 44, as is visualized in FIG. 1 by respective arrows. Thus, a total of two recirculating air circuits are closed, and the oxidation furnace 10 in terms of flow technology is operated on the above-mentioned "center-to-end" principle. However, all other known flow principles may also be implemented.

The blower installation 40 comprises a plurality of blower boxes 52 which each define one exit window 54 of the blower installation 40 that in terms of flow technology is open, said exit windows 54 each extending transversely to the longitudinal furnace direction. The exit windows 54 point in the direction of the suction installation 44 that is opposite thereto. The suction installations 44 in turn each comprise a plurality of suction boxes 56 which in terms of flow technology predefine open entry windows 58 of the suction installations 54 that point in the direction of the respective opposite blower installation 42.

Open in terms of flow technology means that a gas flow may flow through the respective windows 54 or 58 out of the blower installation 40, or into the suction installation 44, respectively. To this end, the windows 54, 58 may be configured for example in that a respective wall has been omitted in the blower boxes 52 or in the suction boxes 56, respectively. Therein, a wall of a blower box 52, or of a suction box 56, respectively, may optionally however also be provided with flow passages.

Figure 2:
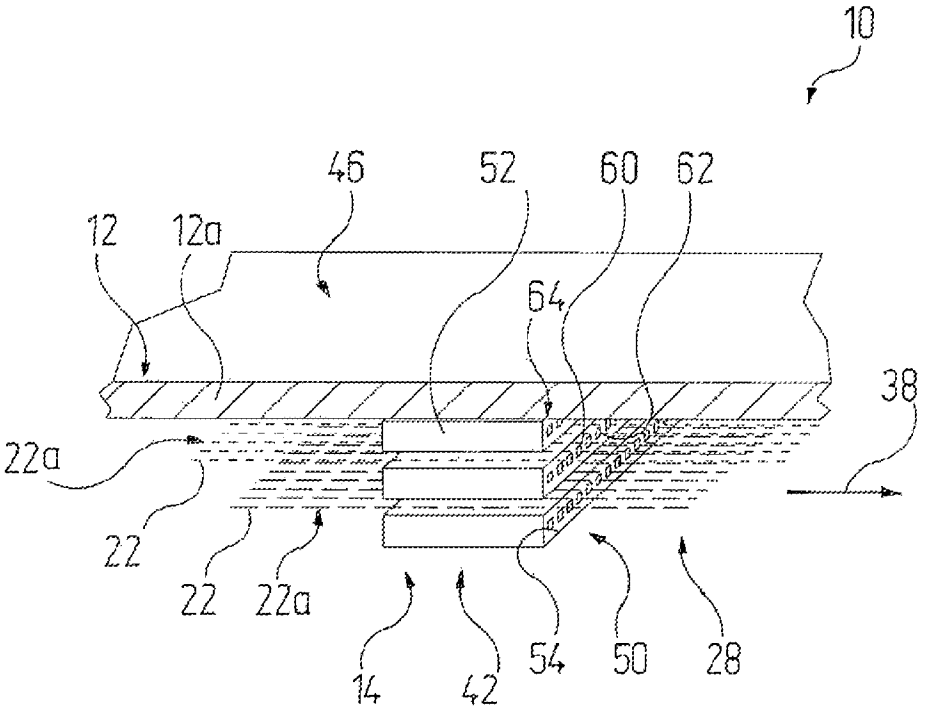
FIG. 2 shows a perspective detailed fragment with a view onto a blower installation of the atmosphere generating installation and associated flow directing elements of the flow directing installation.

As can be seen in FIG. 2, the flow directing installation 50 comprises flow directing elements 60 having flow passages 62, wherein in each case at least one flow directing element 60 is disposed in front of an exit window 54 of the blower installation 42, that is to say in the present exemplary embodiment in front of an exit window 54 of an associated blower box 52. Only one flow directing element 60, and thereof only one flow passage 62, is provided with a reference sign.

At least the flow openings 62 of the flow directing installation 50 have to now be cleaned at regular intervals, so as to maintain the flow of the operating atmosphere 38 in a reproducible manner. To this end, the contaminations mentioned at the outset that in the course of the operation of the oxidation furnace 10 are deposited on the flow passages 62 are removed.

For this purpose, the flow directing elements 60 each are configured so as to be replaceable, and are mounted in a releasable and/or movable manner in front of a respective exit window 54 on the blower installation 42. To this end, the flow directing installation 50 comprises a holding installation 64 by means of which the flow elements 60 may be releasably and/or movably mounted.

The flow passages 62 of the flow directing elements 60 are perfused by the operating atmosphere 38, prior to the latter entering the process chamber 28, wherein said flow passages 62 influence the release direction, the release velocity and, on account thereof, the flow pressure of the operating atmosphere 38. The flow passages 62 of the flow directing elements 60 are dimensioned and disposed in such a manner that the overall flow of the operating atmosphere 38 is homogenized across the furnace cross section. The flow passages 62 may be identical or else dissimilar in terms of the geometry, dimensions, and arrangement thereof.

Figure 3:
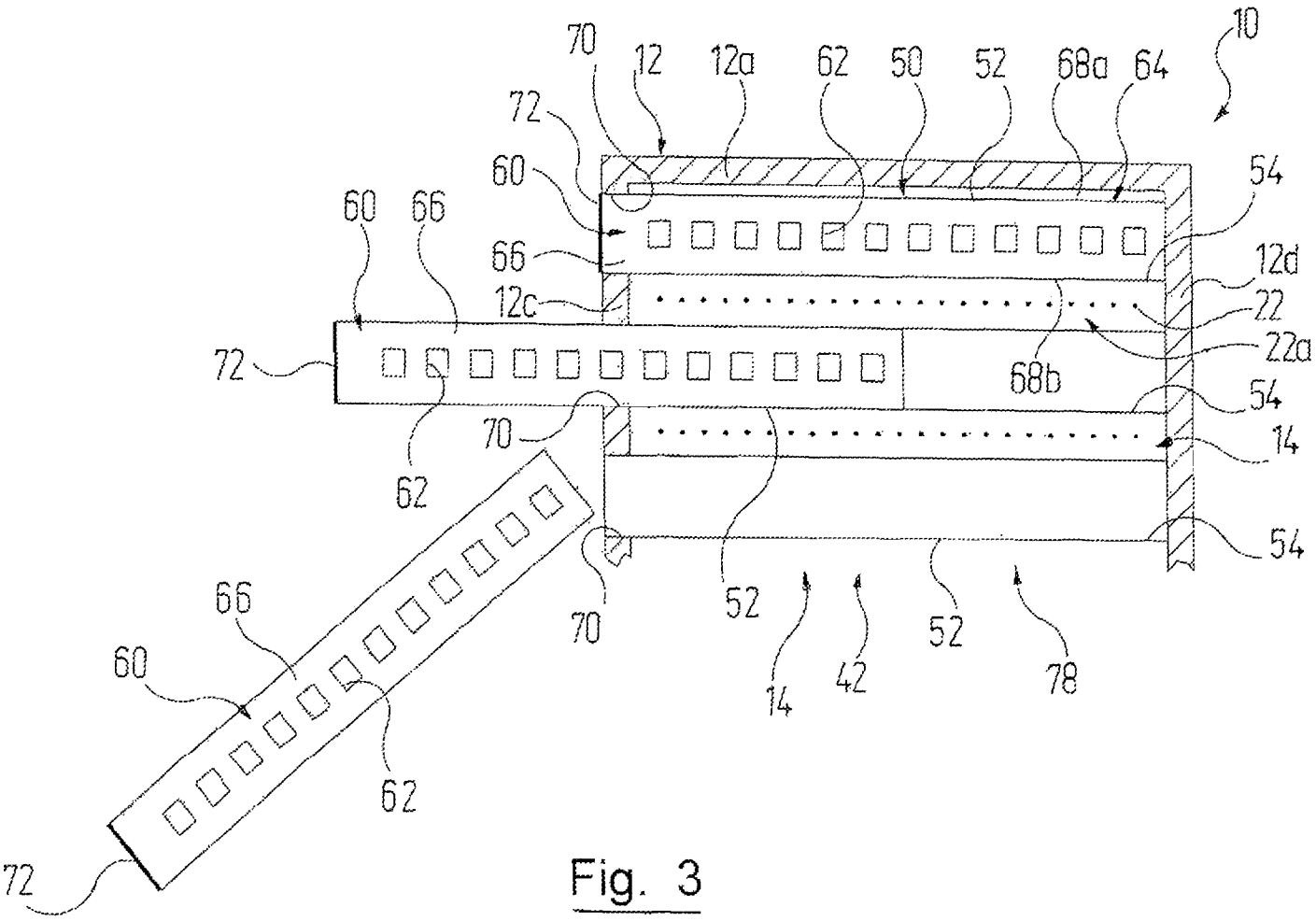
FIG. 3 shows a fragment of a cross section of the oxidation furnace, with a view onto the blower installation, with a flow directing installation according to a first exemplary embodiment.

A first exemplary embodiment of the flow directing installation 50 is visualized in FIG. 3. Therein, a flow directing element 60 is configured as an elongate plate 66 having flow passages 62, said elongate plate 66 being dimensioned so as to be able to completely cover an exit window 54 of the blower installation 40. The holding installation 64 is configured by pairs of guide rails 68*a*, 68*b* for the flow directing elements 60, wherein in each case one guide rail 68*a* runs on the upper periphery, and one guide rail 68*b* runs on the lower periphery, along an exit window 54 of the blower installation 42; each one rail pair 68*a*, 68*b* may receive one flow directing element 60. In each case only that rail pair 68*a*, 68*b* on the topmost blower box 52 is provided with a reference sign in FIGS. 3 to 6.

The guide rails 68*a*, 68*b* extend on and through a longitudinal wall, in the present example through the first longitudinal wall 12*c* of the furnace housing 12 in which in each case one passage opening in the form of a passage slot 70 is provided so as to be level in height with each blower box 52, such that a flow directing element 60 may be pushed through the longitudinal wall 12*c* into the guide rails 68*a*, 68*b* and in front of the associated exit window 54, into the interior 14 of the oxidation furnace 10, and may be retrieved therefrom again.

In general terms, the passage slots 70 are an example of access means by a flow directing element 60 is accessible from outside the process chamber. In one modification (not shown separately) a door may also be present in a longitudinal wall 12*c* or 12*d*, said door extending across the required height of the oxidation furnace 10 such that all flow directing elements 60 are accessible in the case of an opened door.

The uppermost flow directing element 60 in FIG. 3 is shown in an operating position in front of the exit window 54 of the uppermost blower box 52. The central flow directing element 60 assumes an intermediate position in which the former pushed approximately halfway into the guide rails 68*a*, 68*b*, covering the exit window 54 approximately halfway. This intermediate position we pass both during insertion as well as retrieval of the flow directing element 60. The lower flow directing element 60 in FIG. 3 has been removed from the interior 14 of the oxidation furnace 10, and may therein be replaced by a non-contaminated flow directing element 60 which then may be pushed into the operating position in front of the exit window 54 of the lower blower box 52 in FIG. 3, on account of which a contaminated flow directing element 60 is replaced by a flow directing element 60 that is free from contaminations.

In order for the flow directing elements 60 to be able to be manually retrieved from the interior 14 of the oxidation furnace 10 and also be pushed back into the interior 14 of the latter by a maintenance technician, the flow directing elements 60 at one end carry a handle 72. There, sealing means (not provided with a dedicated reference sign) by way of which the passage slot 70 in the case of a pushed-in flow directing element 60 is sealed are also present such that no furnace atmosphere may reach the exterior.

Figure 4:
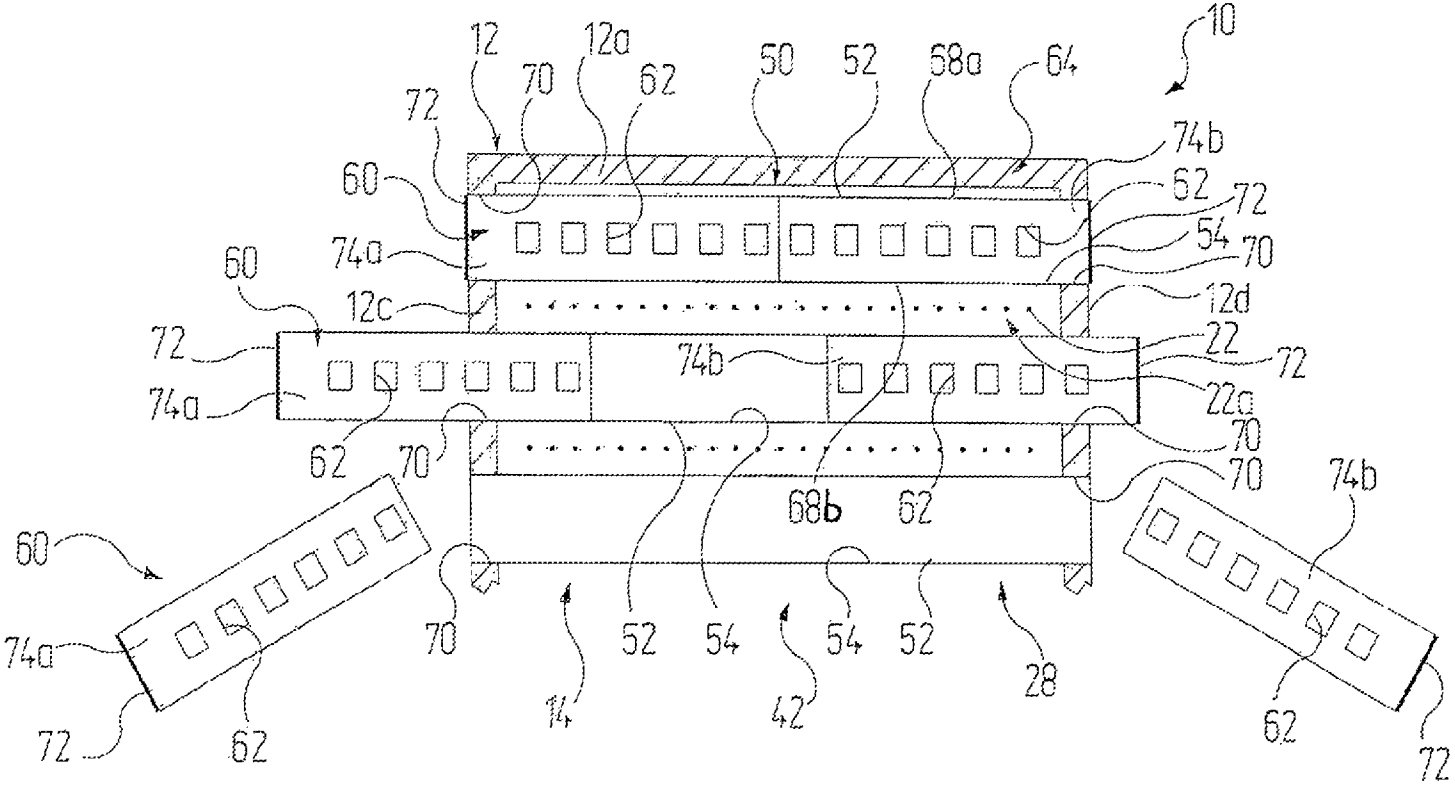
FIG. 4 shows a fragment corresponding to FIG. 3, with a flow directing installation according to a second exemplary embodiment.

FIG. 4 visualizes a second exemplary embodiment of the flow directing installation 50. Flow directing elements 60 therein are present in the form of plate-shaped flow directing modules 74 having flow passages 62, of which in each case two that are beside one another cover one exit window 54, and on the handles 72 of which sealing means (again likewise not provided with a dedicated reference sign) are present. In the drawing and hereunder, the flow directing modules are referred to as flow directing modules 74*a* and 74*b*. Passage slots 70 are not only provided in the first longitudinal wall 12*c* of the oxidation furnace 10, but also in the opposite second longitudinal wall 12*d* thereof, so as to be at the same height. In this way, a first flow directing module 74*a* may be pushed through the passage slot 70 in the first longitudinal wall 12*c*, and a second flow directing module 74*b* may be pushed through the passage slot 70 in the second longitudinal wall 12*d* of the housing 12, such that a pair of the flow directing modules 74*a*, 74*b* as the flow directing element 60 covers a respective exit window 54 of the blower installation 42. As is the case also with the longitudinal wall 12*c*, the guide rails 68*a*, 68*b* also extend through the passage slots 70 in the longitudinal wall 12*d*.

The two flow directing modules 74*a*, 74*b* in FIG. 4 are shown at the topmost blower box 52, in an operating position in front of the exit window 54 of the latter, in which operating position the former collectively form the flow directing element 60. The flow directing modules 74*a*, 74*b* in the case of the central blower box each occupy an intermediate position in which the former each protrude through the passage slots 70. The lower flow directing modules 74*a*, 74*b* in FIG. 4 have been removed from the interior 14 of the oxidation furnace 10 and therein may each be replaced by a non-contaminated flow directing module 74*a* and 74*b*, respectively, the latter two then being able to be pushed into the operating position in front of the exit window 54 of the lower blower box 52 in FIG. 4.

Figure 5:
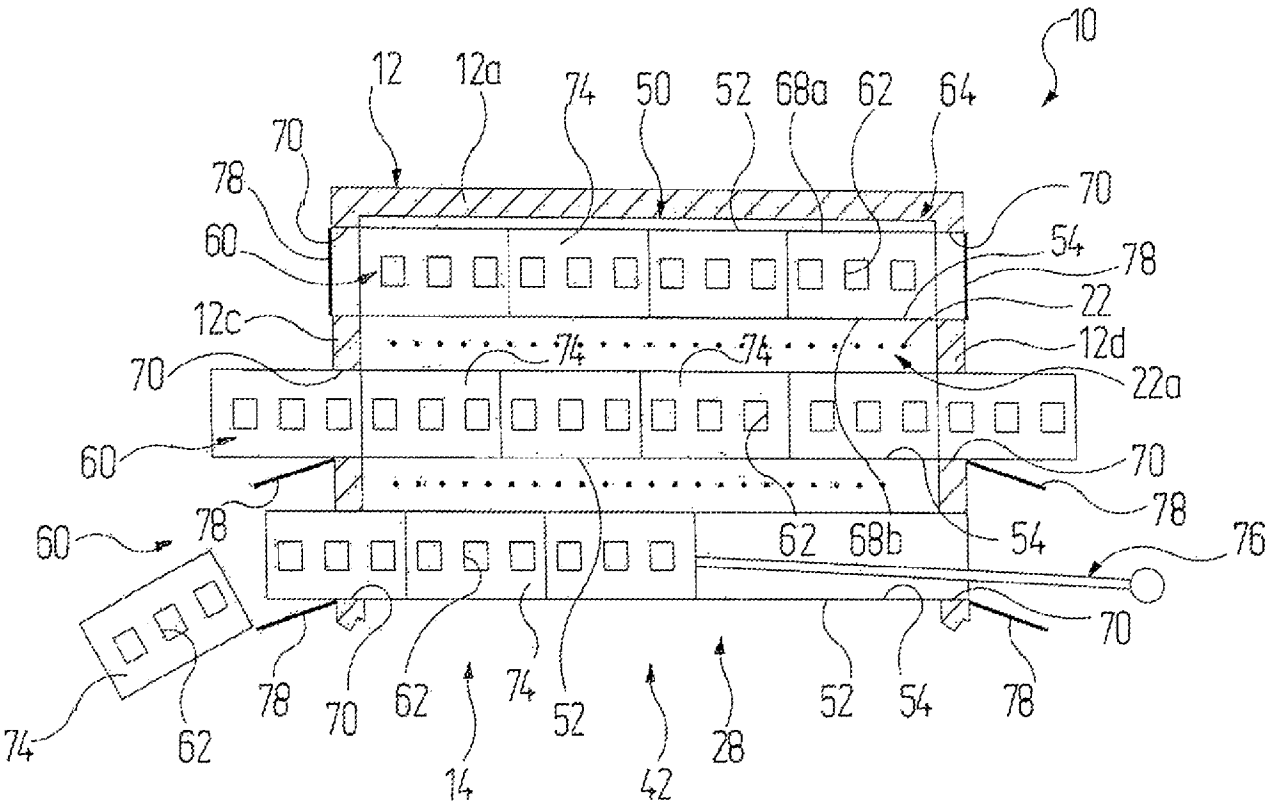
FIG. 5 shows a fragment corresponding to FIGS. 3 and 4, with a flow directing installation according to a third exemplary embodiment.

FIG. 5 shows a third exemplary embodiment of the flow directing installation 50, in which flow directing elements 60 are formed in the form of flow directing modules 74 of which more than two cover one exit window 54. To this end, in the present exemplary embodiment, in each case four plate-shaped flow directing modules 74 are required, wherein only some flow modules 74 carry a reference sign. The plurality of flow directing modules 74 in operation are replaced at intervals, to which end the former in the intermittent passage of the longitudinal wall 12*d* are displaced along the guide rails 68*a*, 68*b* in the direction toward the longitudinal wall 12*c*. To this end, in the case of a first variant that is visualized in FIG. 5 at the central blower box 52, a flow directing module 74 at the passage slot 70 may be offered up on the side of the longitudinal wall 12*d* and pushed into the guide rails 68*a*, 68*b*. On account thereof, that flow directing module 74 that is located at the opposite end on the longitudinal wall 12*c* is ejected from the guide rails 68*a*, 68*b* through the passage slot 70 therein, and may be received by a maintenance technician.

In the case of a second variant that is visualized in FIG. 5 at the lower blower box 52, all flow directing modules 74 are simultaneously ejected from the guide rails 68*a*, 68*b* with the aid of a tool 76, and are replaced as a set by non-contaminated flow directing modules 74.

The slots 70 in the case of this exemplary embodiment are covered by sealing means in the form of movable flaps 78 which may also be present in the case of all other exemplary embodiments described. Instead of the flaps 78, other sealing means in the form of, for example, bristle-type seals, slat-type seals, or the like, may also be present. Such seals may also be present in the case of the exemplary embodiments as per FIGS. 3 and 4. Replaceable plugs may also be employed.

Figure 6:
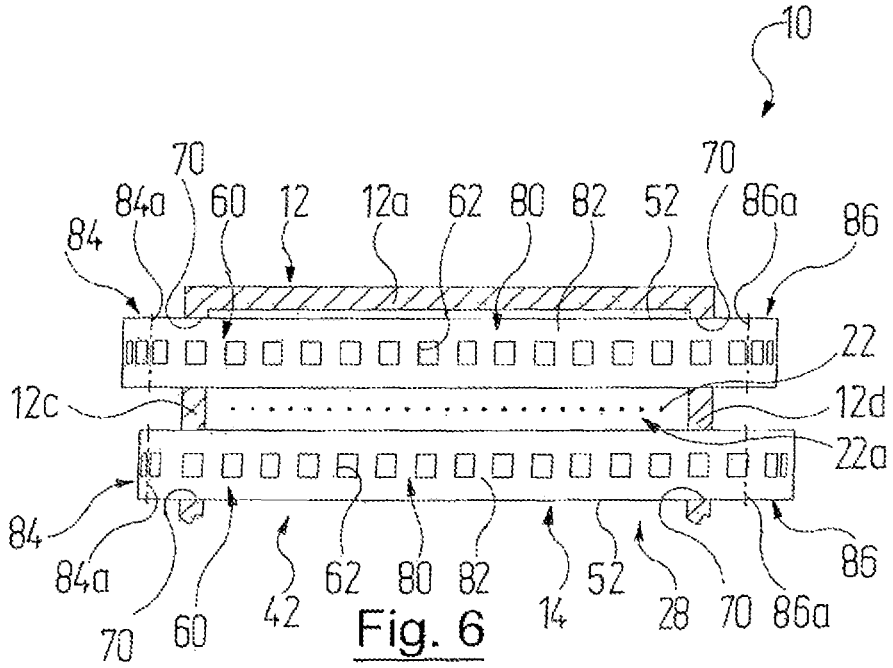
FIG. 6 shows a fragment similar to FIGS. 3 to 5, with a flow directing installation according to a fourth exemplary embodiment.
Figure 7:
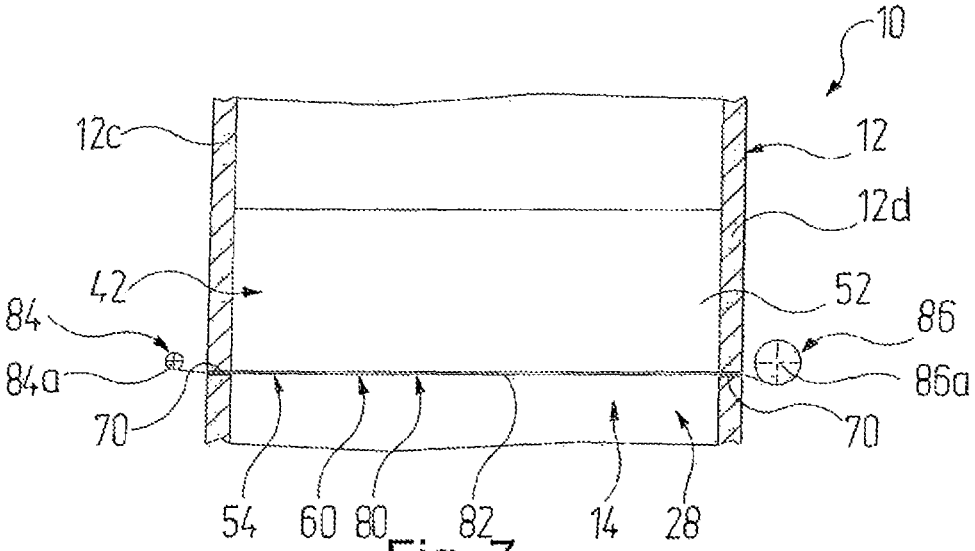
FIG. 7 shows a fragment of the section of FIG. 1, with a view from above onto the flow directing installation as per FIG. 6.

FIGS. 6 and 7 show a fourth exemplary embodiment of the flow directing installation 50. Therein, the exit window 54 of a blower box 52 is in each case covered by a portion 80 of a wound tape 82 having flow passages 62, said wound tape 82 thus defining a flow directing element 60. The wound tape 82 in terms of the dimensions thereof is complementary to the exit windows 54 of the blower installation 42, and is in each case guided by way of two opposite passage slots 70 in the longitudinal walls 12*c*, 12*d* of the furnace housing 12. Thus, passage slots 70 in the longitudinal wall 12*d* each form one entry opening, and passage slots 70 in the opposite longitudinal wall 12*c* each form one exit opening for an associated wound tape 82.

A rotatably mounted source roll 84, on which the wound tape 82 is kept available, and from which the wound tape 82 is guided through the process chamber 28 to the opposite side of the furnace housing 12 to a take-up roll 86, is located outside the furnace housing 12, the take-up roll 86 likewise being mounted outside the housing 12. Vertical rotation axes of the respective source rolls 84 and take-up rolls 86 are identified by 84*a* and 86*a*, respectively, in FIG. 6. The wound tape 82 is thus held taut, and is movable along the exit window 54, between the two rolls 84, 86.

If and when the flow passages 62 of one of the wound tapes 82 are contaminated such that an exchange of the flow directing element 60 is appropriate, the wound tape 82 is unwound from the source roll 84 such that the portion 80 is moved out of the process chamber 28 and is wound onto the take-up roll 86. A subsequent clean portion 80 of the wound tape 82 then defines a replaced flow directing element 60 that takes the place of the preceding flow directing element 60 in the form of the preceding wound tape portion 80.

In FIG. 6, for example, in the case of the lower wound tape 82 more wound tape 82 has been unwound from the source roll 84 than is the case with the topmost wound tape 82 that runs above the former. FIG. 7 shows this lower wound tape 82.

In the case of this variant, the wound tape 82 is intermittently moved. Alternatively, the wound tape 82 may also be continuously moved as long as the flow pattern of the operating atmosphere 38 is not influenced in an undesirable manner by the movement of the flow passages 62 that is performed herein.

The source rolls 84 and the take-up rolls 86 for moving the wound tape 82 each may be driven by a motor or manually by a maintenance technician.

If and when the wound tape 82 has been completely unwound from the source roll 84, the now empty source roll 84 is replaced by a source roll 84 that is loaded with a clean wound tape 82, and the now full take-up roll 86 is replaced by an empty take-up roll 86.

Figure 8:
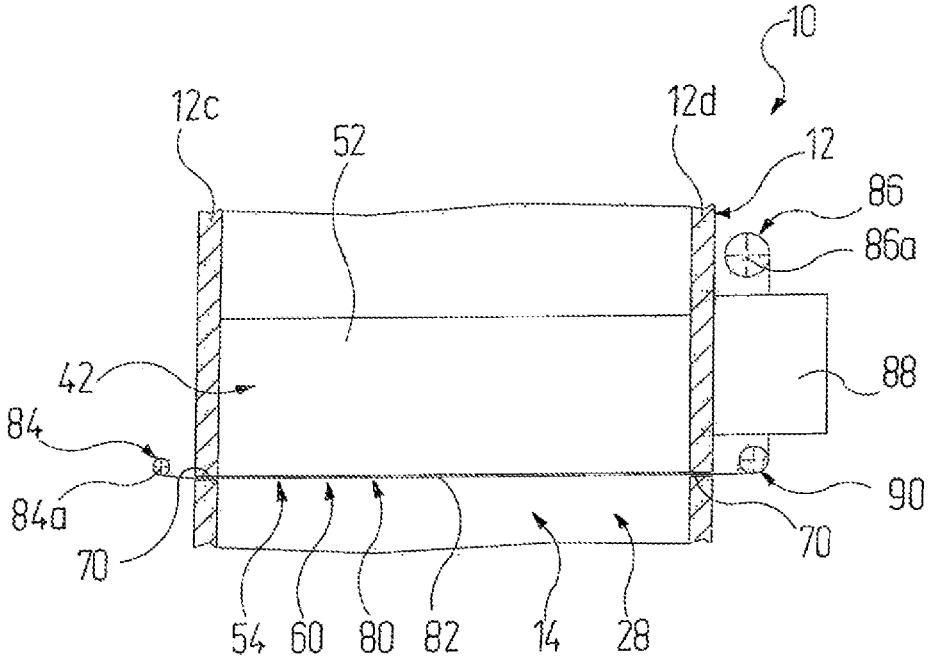
FIG. 8 shows a fragment corresponding to FIG. 7, with a yet again modified flow directing installation.

FIG. 8 shows a variant in which the wound tape 82, having left the process chamber 28 through the longitudinal furnace wall 12*d*, is guided through a cleaning installation 88 which is disposed between the passage slot 12*d* and the take-up roll 86.

The wound tape 82 herein is deflected by way of a deflection roller 90 toward the cleaning installation 88. The wound tape 82 may also enter the cleaning installation 88 directly, without a deflection roller 90.

The wound tape 82, in the continual intermittent passage in the cleaning installation 88, is relieved from contaminations and deposits such that the take-up roll 86 becomes the source roll 84 once the wound tape 82 has been completely unwound from the original source roll 84.

In practice, the flow directing elements 60 are made of steel panel that can withstand the furnace atmosphere. The wound tape 82 may be made from a correspondingly flexible spring steel, for example.

Deposits which in the course of time increasingly restrict the flow path and which have to be removed at regular intervals arise also on the entry windows 58 of the suction installations 44.

Therefore, the explanations above, pertaining to the blower installation 42, also analogously apply in a corresponding manner to the suction installations 44. Contaminations which have to be removed at regular intervals are also deposited there in the course of time. Each suction installation 44 is assigned one suction directing installation 92 which are provided with a reference sign only in FIG. 1, and by way of which the operating atmosphere flows into the respective suction installation 44. Corresponding replaceable flow elements which may be replaced and cleaned at the appropriate time may now be provided in an analogous manner in front of their entry windows 58 of the suction installations 44.

A plurality of exemplary embodiments of the flow directing elements 60 may also be implemented in the case of one flow directing installation 50, wherein dissimilar flow directing elements 60 are then used in each case between two planes of the fiber carpet 22*a*.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

What is claimed is:

1. An oxidation furnace for the oxidative treatment of fibers comprising:

a) a housing which except for passage openings for the fibers is gastight;

b) a process chamber which is located in an interior of the housing;

c) deflection rollers which guide the fibers in a serpentine manner such that they lie beside one another in the form of a fiber carpet through the process chamber, wherein the fiber carpet defines a plane between respective mutually opposite deflection rollers;

d) an atmosphere generating installation, by way of which an operating atmosphere comprising heated air is generated, and which comprises a blower installation having at one or more exit windows through which the operating atmosphere is capable of being blown into the process chamber between two adjacent planes of the fiber carpet, each of the one or more exit windows being positioned on an outer side of the blower box facing the process chamber, each of the one or more exit windows being bound on a first side by a first guide rail and on a second side by a second guide rail, and extending to an access means at a third side, each of the one or more exit windows having a distinct first guide rail, a distinct second guide rail, and a distinct access means; wherein e) the operating atmosphere reaches the process chamber by way of a flow directing installation which is mountable to a periphery of the blower installation, wherein f) the flow directing installation comprises replaceable flow directing elements having flow passages, the replaceable flow directing elements being mountable in a removable manner through each access means into each of the first and second guide rails such that the removable flow directing elements extend across the at least one exit window of the blower installation and partially fill the outer side of the blower box comprising the at least one exit window, the flow passages forming a pathway for the operating atmosphere from the at least one exit window to the process chamber.

2. The oxidation furnace as claimed in claim 1, wherein each of the one or more exit windows extends substantially from a first longitudinal wall to an opposite second longitudinal wall of the housing.

3. The oxidation furnace as claimed in claim 1, wherein the access means are configured by two mutually opposite passage openings in two mutually opposite longitudinal walls of the housing.

4. The oxidation furnace as claimed in claim 1, wherein each replaceable flow directing element is configured as an elongate plate by way of which the one or more exit windows of the blower installation are completely coverable.

5. The oxidation furnace as claimed in claim 1, wherein two or more replaceable flow directing elements in the form of flow directing modules are present and two or a plurality of the flow directing modules cover the one or more exit windows.

6. The oxidation furnace as claimed in claim 1, wherein the replaceable flow directing elements are configured by a wound tape which is stretched and movable along the one or more exit windows between a source roll and a take-up roll such that a portion of the wound tape covers the one or more exit windows.

7. The oxidation furnace as claimed in claim 6, wherein the source roll and the take-up roll are disposed outside the housing and the wound tape is guided through two mutually opposite passage openings in two mutually opposite longitudinal walls of the housing.

8. The oxidation furnace as claimed in claim 7, wherein a cleaning installation through which the wound tape upon leaving the process chamber is guided is present.

9. The oxidation furnace as claimed in claim 1, wherein the replaceable flow directing elements are configured by a wound tape which is stretched and movable along the one or more exit windows between a source roll and a take-up roll such that a portion of the wound tape covers each of the one or more exit windows.

10. The oxidation furnace as claimed in claim 7, wherein a cleaning installation through which the wound tape upon leaving the process chamber is guided is present.

11. The oxidation furnace as claimed in claim 1, wherein the housing comprises a plurality of passage openings in a longitudinal wall of the housing, each replaceable flow directing element being removable from the housing through one passage opening from the plurality of passage openings.

12. The oxidation furnace as claimed in claim 11, further comprising a plurality of sealing means, each sealing means from the plurality of sealing means being configured to selectively block access to a passage opening from the plurality of passage openings.

13. The oxidation furnace as claimed in claim 11, further comprising a door fixed to a wall of the housing and being configured to selectively block access to each of the plurality of passage openings.

* * * * *